US011766579B2

(12) United States Patent
Fazzio et al.

(10) Patent No.: US 11,766,579 B2
(45) Date of Patent: Sep. 26, 2023

(54) SIMULTANEOUSLY DISCHARGING FIRE EXTINGUISHER

(71) Applicant: Kidde Technologies, Inc., Wilson, NC (US)

(72) Inventors: Mark P. Fazzio, Wilson, NC (US); Harlan Hagge, Zebulon, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 62 days.

(21) Appl. No.: 16/782,839

(22) Filed: Feb. 5, 2020

(65) Prior Publication Data

US 2021/0236866 A1 Aug. 5, 2021

(51) Int. Cl.

| | |
|---|---|
| ***A62C 35/02*** | (2006.01) |
| ***A62C 37/36*** | (2006.01) |
| ***A62D 1/00*** | (2006.01) |
| ***A62C 3/08*** | (2006.01) |
| ***A62C 99/00*** | (2010.01) |

(52) U.S. Cl.

CPC ..... *A62C 35/023* (2013.01); *A62C 3/08* (2013.01); *A62C 37/04* (2013.01); *A62C 99/0018* (2013.01); *A62D 1/0092* (2013.01)

(58) Field of Classification Search

CPC ..... A62C 35/023; A62C 37/04; A62C 5/002; A62C 5/008; A62C 5/022; A62C 99/0018; A62C 99/0072; A62C 31/02; A62C 35/68; A62C 13/64; A62D 1/0092

See application file for complete search history.

(56) References Cited

U.S. PATENT DOCUMENTS

| | | | | |
|---|---|---|---|---|
| 2,989,123 | A * | 6/1961 | Holmes | A62C 5/002 137/897 |
| 5,632,337 | A * | 5/1997 | Sundholm | A62C 35/023 169/9 |
| 6,422,320 | B1 | 7/2002 | Mather et al. | |
| 6,513,602 | B1 | 2/2003 | Lewis et al. | |
| 6,942,040 | B1 | 9/2005 | Phuong et al. | |
| 9,750,965 | B2 * | 9/2017 | Marlin | B05B 7/0006 |
| 2006/0049215 | A1 | 3/2006 | Lim et al. | |
| 2011/0259617 | A1 * | 10/2011 | Lelic | A62C 31/05 169/46 |

FOREIGN PATENT DOCUMENTS

| | | | | |
|---|---|---|---|---|
| KR | 200345136 | Y1 | 3/2004 | |
| WO | WO01/76765 | * | 10/2001 | B05B 7/04 |
| WO | WO 2002022214 | A2 | 3/2002 | |
| WO | WO2008123837 | * | 10/2008 | A62C 13/62 |
| WO | WO2008123837 | A1 | 10/2008 | |
| WO | WO2011087383 | A1 | 7/2011 | |
| WO | WO2017122002 | A1 | 7/2017 | |

OTHER PUBLICATIONS

Extended European Search Report for EP Application No. 20209437.1, dated May 14, 2021, pp. 9.

* cited by examiner

*Primary Examiner* — Christopher R Dandridge
(74) *Attorney, Agent, or Firm* — Kinney & Lange, P.A.

(57) ABSTRACT

An aircraft fire suppression system includes a container filled with gases in both a liquefied state and a compressed gas state. The container includes a first tube positioned in the liquefied gas section configured to expel a regulated amount of liquefied gas into the fire suppression system. The container also includes a second tube positioned in the compressed gas section configured to expel a regulated amount of compressed gas into the fire suppression system.

20 Claims, 3 Drawing Sheets

SIMULTANEOUSLY DISCHARGING FIRE EXTINGUISHER

BACKGROUND

The present disclosure relates to an aircraft fire suppression system, and in particular, to a fire extinguishing container used in an aircraft fire suppression system.

Aircraft fire suppression systems are utilized on an aircraft to sense and extinguish fires that occur onboard the aircraft. Some aircraft fire suppression systems require fire suppression agents be stored in various physical states, such as one liquefied gas and another as a compressed gas. In current fire extinguishing containers, the liquefied gas is expelled from the fire extinguishing container first and then the compressed gas is expelled after the liquefied gas. Further, in current fire extinguishing containers the compressed gas is used solely as the propellant to force the liquefied gas from the fire extinguishing container. Thus, each fire suppression agent is expelled from the fire extinguishing container individually, resulting in an inefficient use of the fire suppression agents.

SUMMARY

In one example, a fire suppression system includes a body, a first tube, and a second tube. The body is configured to store both a liquefied gas and a compressed gas under pressure. The first tube includes a first inlet and a first outlet, wherein the first inlet is in fluidic communication with the liquefied gas within the body. The second tube includes a second inlet and a second outlet, wherein the second inlet is in fluidic communication with the compressed gas within the body. The first outlet and the second outlet are configured to mix the liquefied gas and the compressed gas as they exit the body.

In another example, an aircraft fire suppression system includes a fire extinguishing container, a controller, a discharge tube, and a discharge nozzle. The fire extinguishing container includes a body, a first tube, and a second tube. The body is configured to store both a liquefied gas and a compressed gas under pressure. The first tube includes a first inlet and a first outlet, wherein the first inlet is in fluidic communication with the liquefied gas within the body. The second tube includes a second inlet and a second outlet, wherein the second inlet is in fluidic communication with the compressed gas within the body. The first outlet and the second outlet are configured to mix the liquefied gas and the compressed gas as they exit the body. The controller is electrically connected to the fire extinguishing container and the controller is configured to activate the fire extinguishing container. The discharge tube fluidly connects the fire extinguishing container to the discharge nozzle and the discharge nozzle is configured to expel a gas mixture to extinguish a fire.

In yet another example, a method of operating a fire suppression system includes: discharging a liquefied gas stored within a body through a first tube; discharging a compressed gas stored within the body through a second tube; and mixing the liquefied gas with the compressed gas as they exit the body.

DETAILED DESCRIPTION

Figure 1:
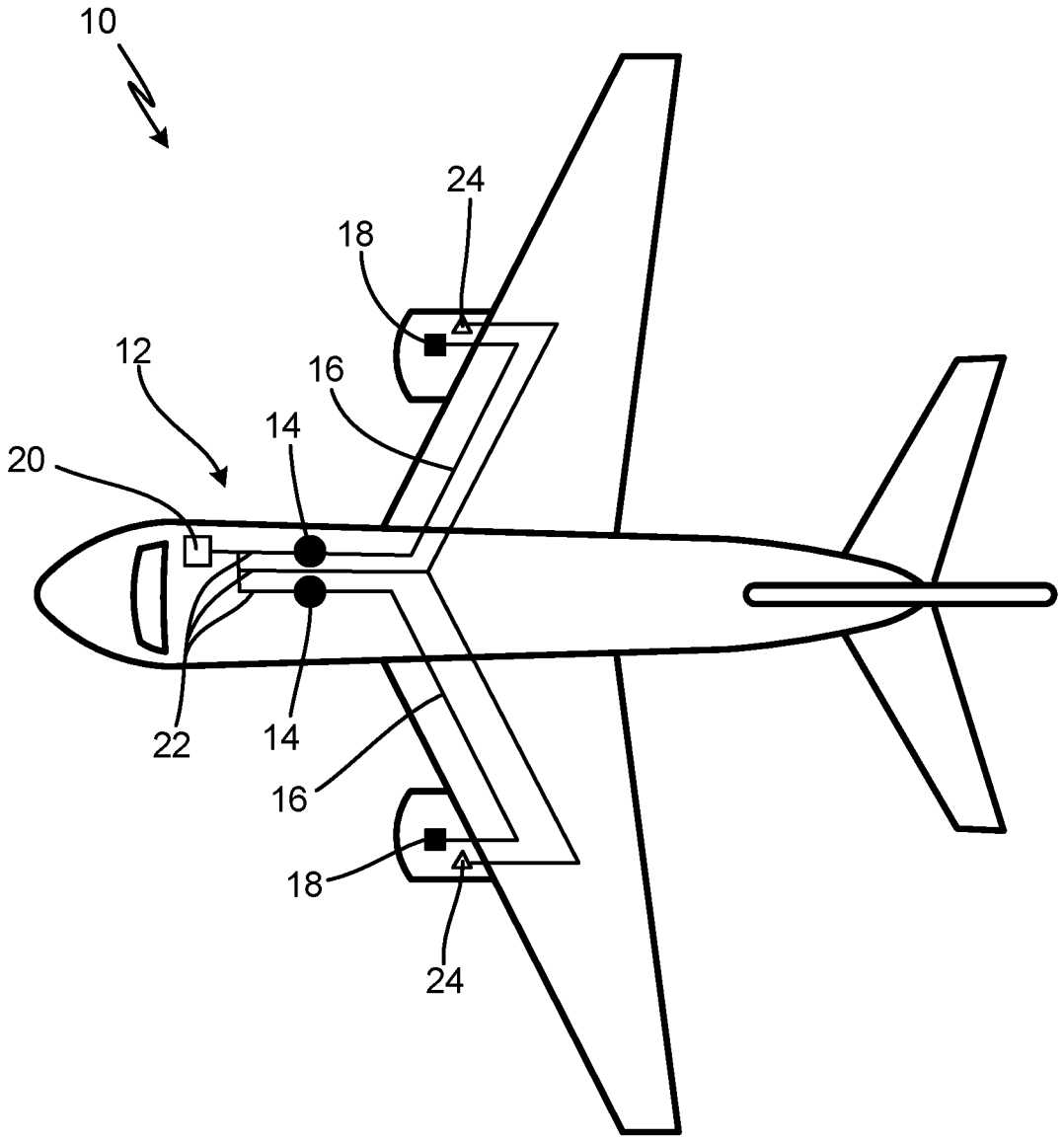
FIG. 1 is a schematic view of an aircraft fire suppression system including a fire extinguishing container.

FIG. 1 is a schematic view of aircraft 10 with aircraft fire suppression system 12 (hereinafter "system 12"). System 12 includes fire extinguishing container 14 (hereinafter "container 14"), discharge tube 16, discharge nozzle 18, controller 20, electrical connections 22, and sensor 24. System 12 is positioned within aircraft 10 and system 12 is configured to sense and extinguish fires that may occur onboard aircraft 10. Container 14 is positioned within aircraft 10 and container 14 is fluidly connected to discharge nozzle 18 through discharge tube 16. In the embodiment shown, there are two of each container 14, discharge tube 16, and discharge nozzle 18. In another embodiment, there can be more than or less than two of each container 14, discharge tube 16, and discharge nozzle 18. In an embodiment where there are multiple containers 14, each container 14 may be of differing size depending on the specific application. Container 14 is configured to store fire suppression agents and then expel the fire suppression agents upon receiving a command to discharge.

Controller 20 is positioned within aircraft 10 and controller 20 is electrically connected to container 14 and sensor 24 through electrical connections 22. Controller 20 can be electrically connected to as many containers 14 and sensors 24 as present on aircraft 10. Controller 20 is configured to send and receive electrical signals to and from container 14 and sensor 24 through electrical connections 22. Sensor 24 is positioned within aircraft 10 and adjacent discharge nozzle 18. Sensor 24 can be configured to detect the presence of smoke, heat, radiation, fire, or other indicator that fire is present within aircraft 10 and send an electrical signal through electrical connections 22 to controller 20 indicating that a fire has been detected. In the embodiment shown, there are two sensors 24 but in another embodiment there can be more than or less than two sensors 24. Further, in the embodiment shown the container 14, discharge tube 16, discharge nozzle 18, controller 20, electrical connections 22, and sensor 24 are shown in specific locations. But it is understood that in another embodiment, these components can be positioned in different locations within aircraft 10. Although controller 20 is described as sending electrical signals through electrical connections 22, it is understood that controller 20 can also send and receive wireless signals through wireless communication technologies and devices to wirelessly communicate with the various components of system 12.

In operation, sensor 24 is actively monitoring an environment for an indication that a fire has been detected within aircraft 10. If sensor 24 detects smoke, heat, radiation, fire, or other indicator that fire is present within aircraft 10, sensor 24 sends an electrical signal through electrical connections 22 to controller 20 indicating that a fire has been detected. After controller 20 receives the signal from sensor 24, controller 20 sends a signal through electrical connections 22 to container 14. The signal received by container 14 directs container 14 to open a valve (not shown) to expel the fire suppression agents within container 14 into discharge tube 16. The fire suppression agents then flow through discharge tube 16 to discharge nozzle 18 where the fire suppression agents dispense onto and extinguish the smoke and/or fire detected by sensor 24. System 12 is configured to sense and extinguish fires that may occur onboard aircraft 10. Although system 12 is described as extinguishing a fire, it is understood that system 12 can also suppress a fire in which the fire within aircraft 10 is not fully extinguished. Further, although discharge nozzle 18 is described as a separate component, it is understood that discharge nozzle 18 can be the end of discharge tube 16, a plurality of holes drilled into discharge tube 16, or any other component or feature that allows the fire suppression agents to expel from discharge tube 16.

Figure 2:
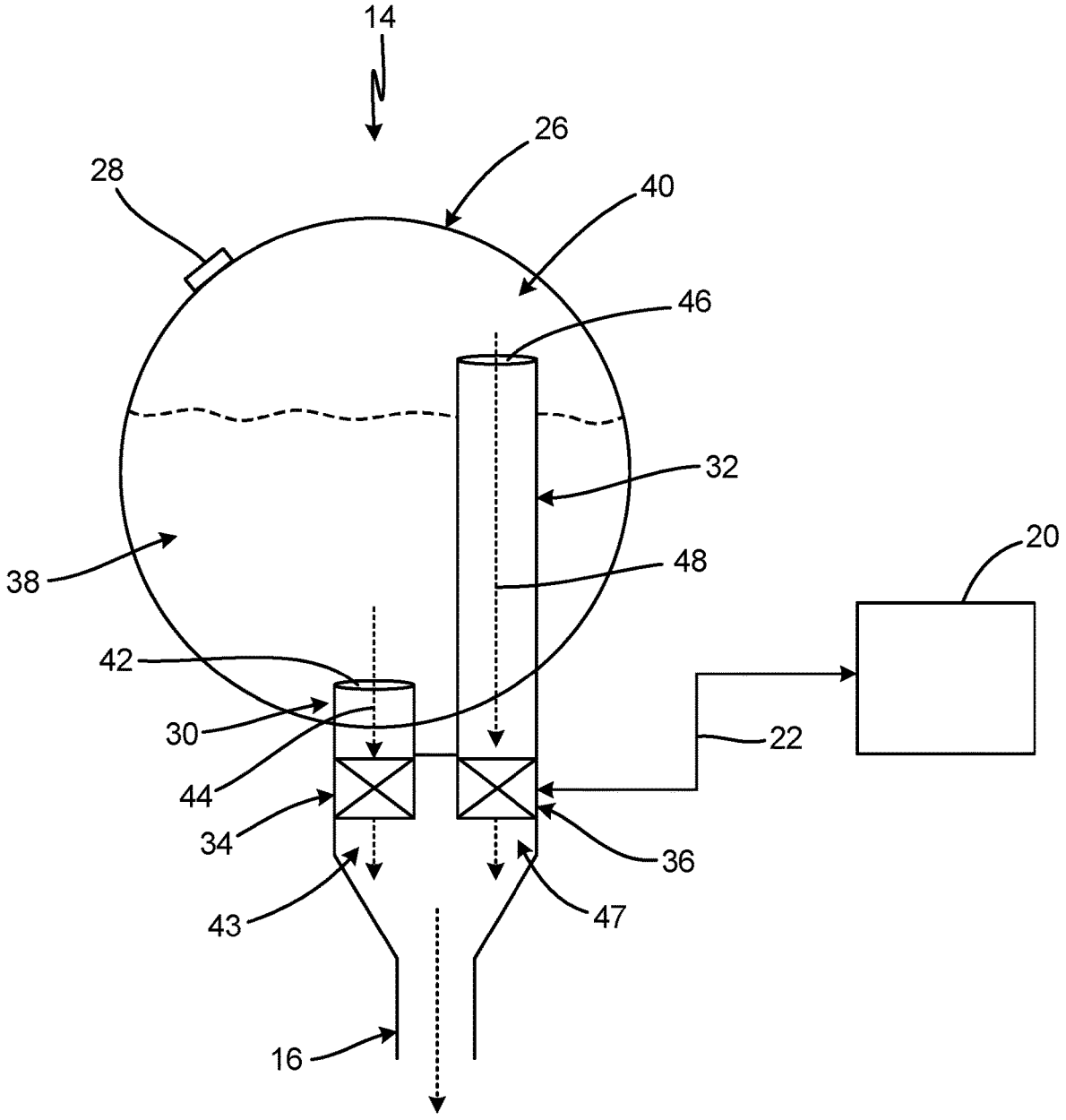
FIG. 2 is a schematic view of a first embodiment of a fire extinguishing container.

FIG. 2 is a schematic view of a first embodiment of container 14 connected to controller 20. Container 14 includes body 26, fill port 28, first tube 30, second tube 32, discharge tube 16, first regulator 34, and second regulator 36. Body 26 is the main structure of container 14. In the embodiment shown, body 26 is spherical in shape but in another embodiment body 26 can be any other shape. Body 26 can be constructed from a metal, polymer, or other material configured to sealingly store gases under pressure. Within body 26 is an internal volume configured to store gases of various physical states under pressure. Although body 26 is described as storing gases of various physical states, it is understood that body 26 can store fluids of various physical states, wherein the physical state of the fluid could be a liquid state or a gas state. Likewise, it should be understood that the term gas is interchangeable with the term fluid throughout this disclosure, wherein the fluid can be in a liquid state or a gas state.

As shown in FIG. 2, body 26 is configured to store both liquefied gas and compressed gas in liquefied gas section 38 and compressed gas section 40, respectively. Due to the mass of the liquefied gas, liquefied gas section 38 is positioned below compressed gas section 40 as gravity forces the heavier liquefied gas to the bottom of body 26 while compressed gas remains positioned above the liquefied gas. Therefore, the liquefied gas and the compressed gas will remain separated within body 26 in liquefied gas section 38 and compressed gas section 40. Fill port 28 is positioned on and extends through body 26. Fill port 28 can be a standard hydraulic fitting configured to allow gases of various physical states to enter body 26 of container 14. More specifically, fill port 28 is configured to allow liquefied gas and compressed gas to be filled into body 26 of container 14.

First tube 30 extends through body 26 of container 14 and first tube 30 includes first inlet 42, first outlet 43, and first flow path 44. First inlet 42 is positioned at an end of first tube 30 and within the liquefied gas of liquefied gas section 38. First tube 30 is configured to allow (upon a discharge command from controller 20) liquefied gas of liquefied gas section 38 to enter first inlet 42 and flow through first flow path 44 to first regulator 34. First regulator 34 is positioned outside of body 26 and within at least a portion of first tube 30. First regulator 34 is configured to control the flow rate of the liquefied gas flowing from liquefied gas section 38, through first tube 30, and to discharge tube 16. First regulator 34 can be a fixed orifice regulator, variable orifice regulator, or other volumetric flow regulator configured to control the flow rate of a liquefied gas under pressure.

Second tube 32 is positioned adjacent to first tube 30 and second tube 32 extends through body 26 of container 14. Further, second tube 32 extends through the liquefied gas of liquefied gas section 38 to the compressed gas of compressed gas section 40. Second tube 32 includes second inlet 46, second outlet 47, and second flow path 48. Second inlet 46 is positioned at an end of second tube 32 and within the compressed gas of compressed gas section 40. Second tube 32 is configured to allow (upon a discharge command from controller 20) compressed gas of compressed gas section 40 to enter second inlet 46 and flow through second flow path 48 to second regulator 36. Second regulator 36 is positioned outside of body 26 and within at least a portion of second tube 32. Second regulator 36 is configured to control the flow rate of the compressed gas flowing from compressed gas section 40, through second tube 32, and to discharge tube 16. Second regulator 36 can be a fixed orifice regulator, variable orifice regulator, or other volumetric flow regulator configured to control the flow rate of a compressed gas under pressure.

First regulator 34 and second regulator 36 are configured to discharge a specific amount of liquefied gas and compressed gas, respectively, to ensure that a defined mixture of gases is achieved. The ratio of liquefied gas to compressed gas will vary depending on the gases that are being used. For example, a mixture of 70% liquefied carbon dioxide and 30% compressed helium is desirable to achieve the proper fire extinguishing properties in specific applications. In other examples, the mixture of the liquefied gas and the compressed gas will vary depending on the gases being used and the desired fire extinguishing properties for each specific application. The regulated liquefied gas and the regulated compressed gas that flow through first regulator 34 and second regulator 36, respectively, combine and mix into a gas mixture at a defined ratio within discharge tube 16. More specifically, first tube 30 and second tube 32 combine into a single discharge tube 16 outside body 26 of container 14, where the liquefied gas and the compressed gas combine into a gas mixture. Discharge tube 16 is positioned adjacent and connected to both first tube 30 and second tube 32. Discharge tube 16 is configured to distribute the gas mixture throughout aircraft fire suppression system 12 to extinguish a fire that may occur onboard aircraft 10. The gas mixture travels through discharge tube 16 to discharge nozzle 18 where the gas mixture is simultaneously expelled from the discharge tube 16 and the discharge nozzle 18 to extinguish a fire within aircraft 10.

In operation, sensor 24 (FIG. 1) monitors an environment within aircraft 10 for an indication of smoke, heat, radiation, fire, or other indicator that fire is present. If sensor 24 detects smoke, heat, radiation, fire, or other indicator that fire is present within aircraft 10, sensor 24 sends an electrical signal through electrical connections 22 to controller 20 indicating that a fire has been detected. After controller 20 receives the signal from sensor 24, controller 20 sends a signal through electrical connections 22 to container 14. The signal received by container 14 directs container 14 to open a valve (not shown) to discharge the fire suppression agents within container 14 into discharge tube 16. More specifically, upon container 14 receiving a discharge signal/command from controller 20, first regulator 34 and second regulator 36 control the amount of liquefied gas and compressed gas, respectively, that exit body 26 of container 14 and enter discharge tube 16 where they combine into a gas mixture. The gas mixture then flows through discharge tube 16 to discharge nozzle 18 where the gas mixture dispenses onto and extinguishes the fire detected by sensor 24. Accordingly, the liquefied gas and the compressed gas simultaneously expel from discharge tube 16 and discharge nozzle 18 to extinguish a fire within aircraft 10. System 12 is configured to sense and extinguish fires that may occur onboard aircraft 10.

Figure 3:
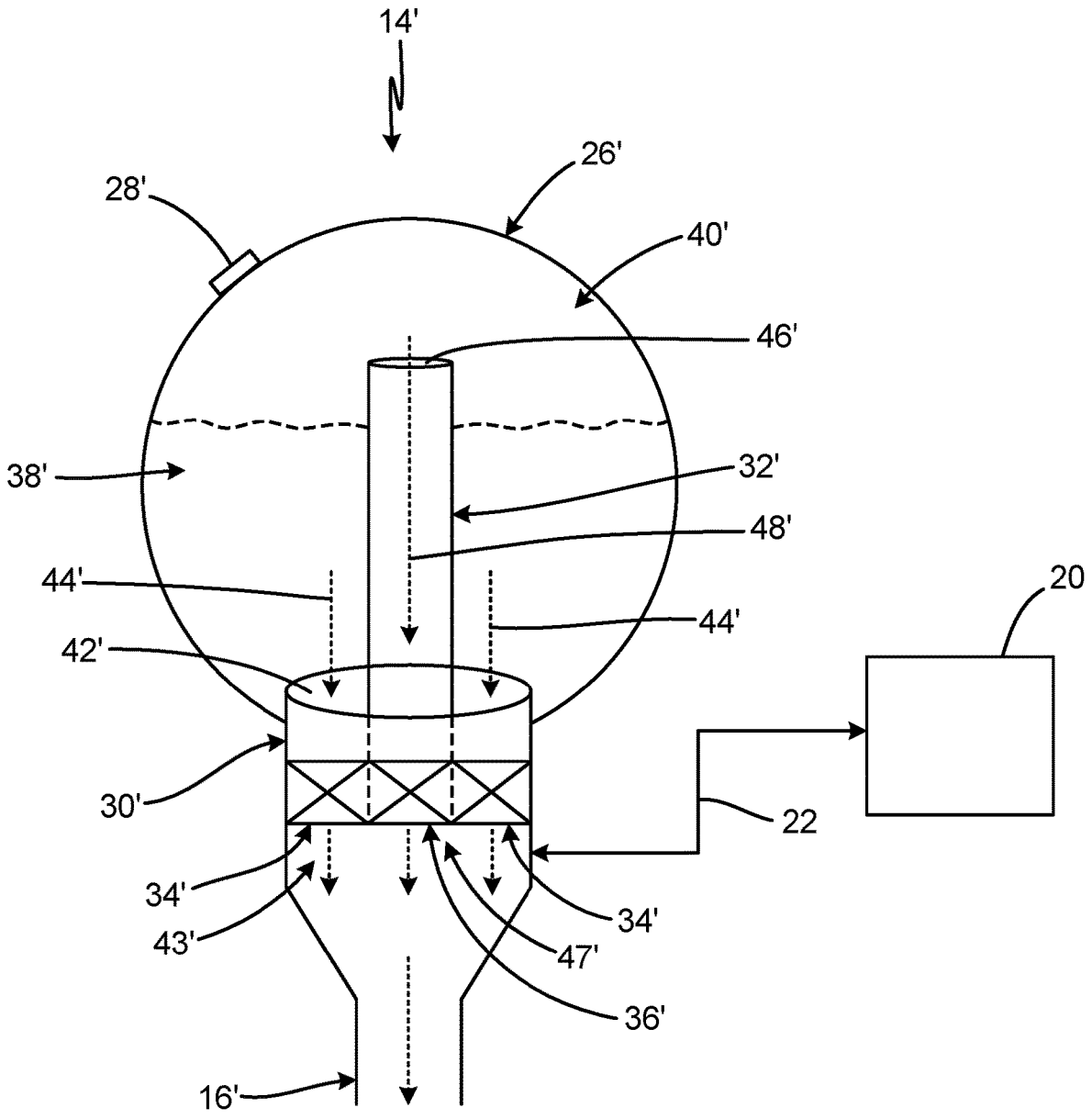
FIG. 3 is a schematic view of a second embodiment of a fire extinguishing container.

FIG. 3 is a schematic view of a second embodiment of container 14' connected to controller 20. Container 14' includes body 26', fill port 28', first tube 30', second tube 32', discharge tube 16', first regulator 34', and second regulator 36'. Body 26' is the main structure of container 14'. In the embodiment shown, body 26' is spherical in shape but in another embodiment body 26' can be any other shape. Body 26' can be constructed from a metal, polymer, or other material configured to sealingly store gases under pressure. Within body 26' is an internal volume configured to store gases of various physical states under pressure.

As shown in FIG. 3, body 26' is configured to store both liquefied gas and compressed gas in liquefied gas section 38' and compressed gas section 40', respectively. Due to the mass of the liquefied gas, liquefied gas section 38' is positioned below compressed gas section 40' as gravity forces the heavier liquefied gas to the bottom of body 26' while compressed gas remains positioned above the liquefied gas. Therefore, the liquefied gas and the compressed gas will remain separated within body 26' in liquefied gas section 38' and compressed gas section 40'. Fill port 28' is positioned on and extends through body 26'. Fill port 28' can be a standard hydraulic fitting configured to allow gases of various physical states to enter body 26' of container 14'. More specifically, fill port 28' is configured to allow liquefied gas and compressed gas to be filled into body 26' of container 14'.

First tube 30' extends through body 26' of container 14' and first tube 30' includes first inlet 42', first outlet 43', and first flow path 44'. First inlet 42' is positioned at an end of first tube 30' and within the liquefied gas of liquefied gas section 38'. First tube 30' is configured to allow (upon a discharge command from controller 20) liquefied gas of liquefied gas section 38' to enter first inlet 42' and flow through first flow path 44' to first regulator 34'. First regulator 34' is positioned outside of body 26' and within at least a portion of first tube 30'. First regulator 34' is configured to control the flow rate of the liquefied gas flowing from liquefied gas section 38', through first tube 30', and to discharge tube 16'. First regulator 34' can be a fixed orifice regulator, variable orifice regulator, or other volumetric flow regulator configured to control the flow rate of a liquefied gas under pressure.

Second tube 32' is positioned within first tube 30' and second tube 32' extends through body 26' of container 14'. Further, second tube 32' extends through the liquefied gas of liquefied gas section 38' to the compressed gas of compressed gas section 40'. Second tube 32' includes second inlet 46', second outlet 47', and second flow path 48'. Second inlet 46' is positioned at an end of second tube 32' and within the compressed gas of compressed gas section 40'. Second tube 32' is configured to allow (upon a discharge command from controller 20) compressed gas of compressed gas section 40' to enter second inlet 46' and flow through second flow path 48' to second regulator 36'. Second regulator 36' is positioned outside of body 26' and within at least a portion of second tube 32'. Second regulator 36' is configured to control the flow rate of the compressed gas flowing from compressed gas section 40', through second tube 32', and to discharge tube 16'. Second regulator 36' can be a fixed orifice regulator, variable orifice regulator, or other volumetric flow regulator configured to control the flow rate of a compressed gas under pressure.

First regulator 34' and second regulator 36' are configured to discharge a specific amount of liquefied gas and compressed gas, respectively, to ensure that a defined mixture of gases is achieved. The ratio of liquefied gas to compressed gas will vary depending on the gases that are being used. For example, a mixture of 70% liquefied carbon dioxide and 30% compressed helium is desirable to achieve the proper fire extinguishing properties in specific applications. In other examples, the mixture of the liquefied gas and the compressed gas will vary depending on the gases being used and the desired fire extinguishing properties for each specific application. The regulated liquefied gas and the regulated compressed gas that flow through first regulator 34' and second regulator 36', respectively, combine and mix into a gas mixture within discharge tube 16'. More specifically, first tube 30' and second tube 32' combine into a single discharge tube 16' within body 26' of container 14', where the liquefied gas and the compressed gas combine into a gas mixture. Discharge tube 16' is positioned adjacent and connected to both first tube 30' and second tube 32'. Discharge tube 16' is configured to distribute the gas mixture throughout aircraft fire suppression system 12 to extinguish a fire that may occur onboard aircraft 10.

In operation, sensor 24 (FIG. 1) monitors an environment within aircraft 10 for an indication of smoke, heat, radiation, fire, or other indicator that fire is present. If sensor 24 detects smoke, heat, radiation, fire, or other indicator that fire is present within aircraft 10, sensor 24 sends an electrical signal through electrical connections 22 to controller 20 indicating that a fire has been detected. After controller 20 receives the signal from sensor 24, controller 20 sends a signal through electrical connections 22 to container 14'. The signal received by container 14' directs container 14' to open a valve (not shown) to expel the fire suppression agents within container 14' into discharge tube 16'. More specifically, upon container 14' receiving a discharge signal/command from controller 20, first regulator 34' and second regulator 36' control the amount of liquefied gas and compressed gas, respectively, that exit body 26' of container 14' and enter discharge tube 16' where they combine into a gas mixture. The gas mixture then flows through discharge tube 16' to discharge nozzle 18 where the gas mixture dispenses onto and extinguishes the smoke and/or fire detected by sensor 24. Accordingly, the liquefied gas and the compressed gas simultaneously expel from discharge tube 16' and discharge nozzle 18 to extinguish a fire within aircraft 10. System 12 is configured to sense and extinguish fires that may occur onboard aircraft 10.

Fire extinguishing containers 14 and 14' provide benefits over traditional or current first extinguishing containers. Containers 14 and 14' allow the liquefied gas and the compressed gas to be combined into a gas mixture before being used to extinguish a fire. In contrast, current fire extinguishing containers use the compressed gas as a propellant to force the liquefied gas through the system and the liquefied gas alone is used to extinguish fires onboard an aircraft. The creation of a gas mixture allows both the liquefied gas and the compressed gas to be used as fire suppression agents, resulting in a more efficient use of the gases/fire suppression agents. Further, storing both the liquefied gas and the compressed gas in a single container rather than two separate containers lowers the system weight and overall system cost. Containers 14 and 14' create a more efficient fire suppression system 12, which ultimately results in cost and weight savings for the fire suppression system 12 onboard aircraft 10.

Discussion of Possible Embodiments

The following are non-exclusive descriptions of possible embodiments of the present invention.

A fire suppression system, among other possible things, includes a body configured to store both a liquefied gas and a compressed gas under pressure; a first tube including a first inlet and a first outlet, wherein the first inlet is in fluidic communication with the liquefied gas within the body; and a second tube including a second inlet and a second outlet, wherein the second inlet is in fluidic communication with the compressed gas within the body; wherein the first outlet and the second outlet are configured to mix the liquefied gas and the compressed gas as they exit the body.

The fire suppression system of the preceding paragraph can optionally include, additionally and/or alternatively, any one or more of the following features, configurations and/or additional components:

A further embodiment of the foregoing fire suppression system, wherein the first tube and the second tube combine into a single discharge tube outside the body of the fire suppression system.

A further embodiment of any of the foregoing fire suppression systems, wherein the first tube and the second tube combine into a single discharge tube within the body of the fire suppression system.

A further embodiment of any of the foregoing fire suppression systems, and further comprising a first regulator positioned within the first tube, wherein the first regulator is configured to control a flow rate of the liquefied gas flowing from the first tube to a discharge tube; and a second regulator positioned within the second tube, wherein the second regulator is configured to control a flow rate of the compressed gas flowing from the second tube to the discharge tube.

A further embodiment of any of the foregoing fire suppression systems, wherein the first regulator is positioned outside the body of the fire suppression system and the second regulator is positioned outside the body of the fire suppression system.

A further embodiment of any of the foregoing fire suppression systems, wherein the liquefied gas and the compressed gas combine into a gas mixture within the discharge tube at a defined ratio, and wherein the gas mixture is simultaneously expelled from the discharge tube to suppress a fire.

A further embodiment of any of the foregoing fire suppression systems, wherein the second tube is positioned at least partially within the first tube.

An aircraft fire suppression system, among other possible things, includes a fire extinguishing container comprising a body configured to store both a liquefied gas and a compressed gas under pressure; a first tube including a first inlet and a first outlet, wherein the first inlet is in fluidic communication with the liquefied gas within the body; and a second tube including a second inlet and a second outlet, wherein the second inlet is in fluidic communication with the compressed gas within the body; wherein the first outlet and the second outlet are configured to mix the liquefied gas and the compressed gas as they exit the body. The aircraft fire suppression system further including a controller electrically connected to the fire extinguishing container, wherein the controller is configured to activate the fire extinguishing container; and a discharge tube fluidly connecting the fire extinguishing container to a discharge nozzle, wherein the discharge nozzle is configured to expel a gas mixture to extinguish a fire.

The aircraft fire suppression system of the preceding paragraph can optionally include, additionally and/or alternatively, any one or more of the following features, configurations and/or additional components:

A further embodiment of the foregoing aircraft fire suppression system, wherein the first tube and the second tube combine into the discharge tube outside the body of the fire extinguishing container.

A further embodiment of any of the foregoing aircraft fire suppression systems, wherein the first tube and the second tube combine into the discharge tube within the body of the fire extinguishing container.

A further embodiment of any of the foregoing aircraft fire suppression systems, and further including a first regulator positioned within the first tube, wherein the first regulator is configured to control a flow rate of the liquefied gas flowing from the first tube to the discharge tube; and a second regulator positioned within the second tube, wherein the second regulator is configured to control a flow rate of the compressed gas flowing from the second tube to the discharge tube.

A further embodiment of any of the foregoing aircraft fire suppression systems, wherein the first regulator is positioned outside the body of the fire extinguishing container and the second regulator is positioned outside the body of the fire extinguishing container.

A further embodiment of any of the foregoing aircraft fire suppression systems, wherein the second tube is positioned at least partially within the first tube.

A further embodiment of any of the foregoing aircraft fire suppression systems, wherein the gas mixture comprises the liquefied gas and the compressed gas at a defined ratio, and wherein the gas mixture combines within the discharge tube and is simultaneously expelled through the discharge tube to the discharge nozzle to extinguish the fire.

A method of operating a fire suppression system, among other possible things, includes discharging a liquefied gas stored within a body through a first tube; discharging a compressed gas stored within the body through a second tube; and mixing the liquefied gas with the compressed gas as they exit the body.

The method of operating an aircraft fire suppression system of the preceding paragraph can optionally include, additionally and/or alternatively, any one or more of the following features, configurations and/or additional components:

A further embodiment of the foregoing method of operating a fire suppression system, wherein the liquefied gas and the compressed gas mix in a discharge tube outside the body.

A further embodiment of the foregoing method of operating a fire suppression system, wherein the liquefied gas and the compressed gas mix in a discharge tube within the body.

A further embodiment of any of the foregoing method of operating a fire suppression system, and further including a first regulator positioned within the first tube, wherein the first regulator is configured to control a flow rate of the liquefied gas flowing from the first tube to the discharge tube; and a second regulator positioned within the second tube, wherein the second regulator is configured to control a flow rate of the compressed gas flowing from the second tube to the discharge tube.

A further embodiment of any of the foregoing method of operating a fire suppression system, wherein the first regulator is positioned outside the body and the second regulator is positioned outside the body.

A further embodiment of any of the foregoing method of operating a fire suppression system, wherein the second tube is positioned at least partially within the first tube.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fire suppression system for use on an aircraft, the fire suppression system comprising:

a fire extinguishing container comprising:

a body configured to store both a liquefied gas and a compressed gas under pressure;

a first tube including a first inlet and a first outlet, wherein the first inlet is in fluidic communication with and terminates in the liquefied gas within the body;

a second tube including a second inlet and a second outlet, wherein the second inlet extends above the liquified gas within the body and is in fluidic communication with the compressed gas within the body;

a first volumetric flow regulator positioned partially within the first tube and partially within a discharge tube, wherein the first volumetric flow regulator is configured to control a flow rate of the liquefied gas flowing from the first tube directly into the discharge tube; and a second volumetric flow regulator positioned partially within the second tube and partially within the discharge tube, wherein the second volumetric flow regulator is configured to control a flow rate of the compressed gas flowing from the second tube directly into the discharge tube; and a controller communicatively coupled to the fire extinguishing container, wherein the controller is configured to activate the fire extinguishing container;

wherein the first volumetric flow regulator and the second volumetric flow regulator are configured to discharge a specific amount of the liquefied gas and the compressed gas at a defined ratio such that liquified gas and the compressed gas mix into a gas mixture within the discharge tube as the liquefied gas and the compressed gas exit the body, wherein both the liquified gas and the compressed gas are used as fire suppression agents.

2. The fire suppression system of claim 1, wherein the first tube and the second tube combine into a single discharge tube outside the body of the fire suppression system.

3. The fire suppression system of claim 1, wherein the first tube and the second tube combine into a single discharge tube within the body of the fire suppression system.

4. The fire suppression system of claim 1, wherein the first volumetric flow regulator is positioned outside the body of the fire suppression system and the second volumetric flow regulator is positioned outside the body of the fire suppression system.

5. The fire suppression system of claim 1, wherein the gas mixture is simultaneously expelled from the discharge tube to suppress a fire.

6. The fire suppression system of claim 3, wherein the second tube is positioned at least partially within the first tube.

7. An aircraft fire suppression system comprising:

a fire extinguishing container comprising:

a body configured to store both a liquefied gas and a compressed gas under pressure;

a first tube including a first inlet and a first outlet, wherein the first inlet is in fluidic communication with and terminates in the liquefied gas within the body; and a second tube including a second inlet and a second outlet, wherein the second inlet extends above the liquefied gas within the body and is in fluidic communication with the compressed gas within the body;

wherein the first outlet and the second outlet are configured to mix the liquefied gas and the compressed gas as they exit the body;

a controller electrically connected to the fire extinguishing container, wherein the controller is configured to activate the fire extinguishing container;

a discharge tube fluidly connects the fire extinguishing container to a first discharge nozzle and fluidly connects the fire extinguishing container to a second discharge nozzle, wherein the first and second discharge nozzles are configured to expel a gas mixture to suppress a fire, wherein both the liquified gas and the compressed gas are used as fire suppression agents; and a first sensor positioned adjacent the first discharge nozzle and remote from the fire extinguishing container, and a second sensor positioned adjacent the second discharge nozzle and remote from the fire extinguishing container;

wherein the first and second sensors are each electrically connected to the controller, wherein the first and second sensors are configured to detect a fire on an aircraft, and wherein the first sensor is positioned remote from the second sensor.

8. The aircraft fire suppression system of claim 7, wherein the first tube and the second tube combine into the discharge tube outside the body of the fire extinguishing container.

9. The aircraft fire suppression system of claim 7, wherein the first tube and the second tube combine into the discharge tube within the body of the fire extinguishing container.

10. The aircraft fire suppression system of claim 7, and further comprising:

a first regulator positioned within the first tube, wherein the first regulator is configured to control a flow rate of the liquefied gas flowing from the first tube to the discharge tube; and a second regulator positioned within the second tube, wherein the second regulator is configured to control a flow rate of the compressed gas flowing from the second tube to the discharge tube.

11. The aircraft fire suppression system of claim 10, wherein the first regulator is positioned outside the body of the fire extinguishing container and the second regulator is positioned outside the body of the fire extinguishing container.

12. The aircraft fire suppression system of claim 9, wherein the second tube is positioned at least partially within the first tube.

13. The aircraft fire suppression system of claim 7, wherein the gas mixture comprises the liquefied gas and the compressed gas at a defined ratio, and wherein the gas mixture combines within the discharge tube and is simultaneously expelled through the discharge tube to the first and second discharge nozzles to suppress the fire.

14. A method of operating an aircraft fire suppression system, the method comprising:

detecting, by a sensor positioned adjacent a discharge nozzle, the presence of a fire within an aircraft;

directing, by a controller in response to the sensor, a fire extinguishing container to discharge fire extinguishing agents, wherein the fire extinguishing agents include a liquified gas and a compressed gas stored under pressure in a body;

discharging the liquefied gas stored within a body of the fire extinguishing container through a first tube, wherein the first tube includes a first inlet and a first outlet and the first inlet is in fluidic communication with and terminates in the liquefied gas within the body;

controlling, by a first volumetric flow regulator, a flow rate of the liquefied gas flowing from the first tube;

discharging the compressed gas stored within the body of the fire extinguishing container through a second tube, wherein the second tube includes a second inlet and a second outlet and the second inlet extends above the liquified gas within the body and is in fluidic communication with the compressed gas within the body;

controlling, by a second volumetric flow regulator, a flow rate of the compressed gas flowing from the second tube;

mixing, by the first volumetric flow regulator and the second volumetric flow regulator, the liquefied gas with the compressed gas at a defined ratio into a mixture within a discharge tube as they exit the body;

flowing the mixture of liquefied gas and compressed gas through the discharge tube to a discharge nozzle positioned remote from the body; and discharging, by the discharge nozzle, the liquefied gas and compressed gas mixture to suppress the fire, wherein both the liquified gas and the compressed gas are used as fire suppression agents.

15. The method of operating an aircraft fire suppression system of claim 14, wherein the liquefied gas and the compressed gas mix in a discharge tube outside the body.

16. The method of operating an aircraft fire suppression system of claim 14, wherein the liquefied gas and the compressed gas mix in a discharge tube within the body.

17. The method of operating an aircraft fire suppression system of claim 14, wherein:

the first regulator is positioned within the first tube and the second regulator is positioned within the second tube.

18. The method of operating an aircraft fire suppression system of claim 17, wherein the first regulator is positioned outside the body and the second regulator is positioned outside the body.

19. The method of operating an aircraft fire suppression system of claim 16, wherein the second tube is positioned at least partially within the first tube.

20. The fire suppression system of claim 1, wherein the compressed gas is helium and the liquified gas is carbon dioxide.

* * * * *